US010322894B2

(12) United States Patent
Buesing

(10) Patent No.: US 10,322,894 B2
(45) Date of Patent: Jun. 18, 2019

(54) CLEANABLE SHEET FEEDER

(71) Applicant: MULTIFEEDER TECHNOLOGY, INC., White Bear Lake, MN (US)

(72) Inventor: Jonathan Buesing, White Bear Lake, MN (US)

(73) Assignee: Multifeeder Technologies, Inc., White Bear Lake, MN (US)

( * ) Notice: Subject to any disclaimer, the term of this patent is extended or adjusted under 35 U.S.C. 154(b) by 0 days.

(21) Appl. No.: 15/967,811

(22) Filed: May 1, 2018

(65) Prior Publication Data

US 2018/0312354 A1 Nov. 1, 2018

Related U.S. Application Data

(60) Provisional application No. 62/492,536, filed on May 1, 2017.

(51) Int. Cl.

| | |
|---|---|
| ***B65H 5/02*** | (2006.01) |
| ***B65H 29/16*** | (2006.01) |
| ***B65H 3/06*** | (2006.01) |
| ***B65H 3/04*** | (2006.01) |

(52) U.S. Cl.

CPC ..... *B65H 5/021* (2013.01); *B65H 3/042* (2013.01); *B65H 3/06* (2013.01); *B65H 29/16* (2013.01); *B65H 2301/531* (2013.01); *B65H 2404/255* (2013.01); *B65H 2519/00* (2013.01); *B65H 2601/324* (2013.01); *B65H 2701/11112* (2013.01); *B65H 2701/176* (2013.01)

(58) Field of Classification Search

CPC ..... B65H 5/021; B65H 3/042; B65H 29/16; B65H 2601/324; B65H 2701/176; B65H 2301/531

See application file for complete search history.

(56) References Cited

U.S. PATENT DOCUMENTS

| | | | | |
|---|---|---|---|---|
| 3,774,905 | A * | 11/1973 | Williams | B05C 1/025 271/250 |
| 5,960,936 | A * | 10/1999 | Kuehnle | B41F 21/005 198/807 |
| 6,050,563 | A | 4/2000 | Vedoy et al. | |
| 6,485,012 | B1 * | 11/2002 | Bakoledis | B65H 1/06 271/124 |
| 7,040,613 | B2 * | 5/2006 | Vedoy | B65H 3/042 271/10.07 |
| 8,490,964 | B2 * | 7/2013 | Kaiping | B65H 3/042 271/9.09 |

* cited by examiner

*Primary Examiner* — Patrick Cicchino

(74) *Attorney, Agent, or Firm* — Dewitt LLP; Thomas J. Nikolai

(57) ABSTRACT

A sheet feeder especially designed for use in the food and pharmaceutical industries is constructed in a hygienic manner and with suitable materials to permit rapid and effective cleaning and sanitizing thereof. Flexible, liquid impermeable bellows are mounted to the feeder housings in surrounding relation to the apertures through which the machine's several rotary shafts enter the housings. The bellows support bearing isolators that not only seal the housings from fluid entry, but because the bellows can flex, they also permit shaft spacings to be adjusted to adapt the machine to sheets of differing thicknesses and to set infeed belt tension. The sheet feeder's product input hopper and its discharge conveyor are designed to be easily detachable for cleaning in a dipping mode.

11 Claims, 16 Drawing Sheets

CLEANABLE SHEET FEEDER

CROSS-REFERENCED TO RELATED APPLICATIONS

This application is a non-provisional application of Application No. 62/492,536, filed May 1, 2017 and claims priority from that application which is also deemed incorporated by reference in its entirety in this application.

STATEMENT REGARDING FEDERALLY SPONSORED RESEARCH OR. DEVELOPMENT

Not applicable

BACKGROUND OF THE INVENTION

I. Field of the Invention

The present invention relates generally to an apparatus for feeding sheet-like articles, one at a time, from the bottom of a stack of such articles and, more particularly, to a sheet feeder especially designed for use in the food, pharmaceutical and medical products industries. The design, construction, and materials must comply with applicable industry and regulatory standards and facilitate effective cleaning and disinfection of the sheet feeder by a variety of methods without harm to the equipment.

II. Discussion of the Prior Art

Over the past twenty years, applicant's assignee, Multifeeder Technology, Inc., of White year, Minnesota, has been manufacturing and selling sheet feeding equipment of the type generally described in the Vedoy et. al U.S. Pat. Nos. 6,050,563 and 7,040,613, the contents of these two patents are hereby incorporated by reference as if set forth in full Machines constructed as described therein have been widely used to feed, one at a time, from a stack of flat articles, such as printed materials, card stock, compact disks, pharmaceutical blister packs and the like at high speeds. However, due to their construction, they failed to meet FDA and other applicable standards for use in the food and other industries where pathogens must be addressed. These standards dictate cleaning and disinfection outcomes for equipment exposed to organic materials, such as food products for human and animal consumption. If the equipment is to be cleaned and disinfected, it necessarily must be taken off-line, which adversely impacts product production, especially if it is to be subjected to pressure washing, washing, and rinsing operations that are needed to remove soilage and pathogens.

In the following discussion of the prior art machine described in the aforereferenced Vedoy patents, the reference numerals are those found in the Vedoy patents referenced above.

To meet the applicable standards and requirements, applicants have redesigned the earlier sheet feeding machines in a way to facilitate effective cleaning and disinfection and comply with above referenced standards. For example, the stripper wheel shaft 54 seen in FIG. 9 of the '563 patent has been redesigned as a single, one-piece, roller, thereby eliminating the need for plural rollers 52 and their joints and crevices which make the earlier machine difficult to clean. Likewise, the feed belt drive shaft 42 of the earlier machine is replaced with a one-piece, multi-crown shaft, again eliminating the need for plural drive rollers 40.

In the design of the present invention, flexible, accordion-pleated, bellows-type gaskets in conjunction with bearing isolators are made to surround the openings in the housings 12, 14 where the ends of the input drive shaft, input idler shaft, the stripper shaft and the upper and lower discharge shafts enter the housings to prevent entry of cleaning solutions into the housings while still allowing tension adjustments of the infeed belts and vertical spacing adjustment of the stripper shaft and upper discharge drive shaft relative to the infeed drive shaft and lower discharge drive shaft.

In the design of the present invention, the entire discharge conveyor assembly is of a unitary construction allowing it to be cleaned in place or readily removed in a matter of a minute or two from the remainder of the sheet feeder, allowing it to be cleaned in a dipping or submersion mode.

The housings 12, 14 of the earlier machine of the '563 patent are now made of stainless steel. The new housing covers of the present invention incorporate a formed in-place internal gasket and mate with the remainder of the box-like enclosures to block entry of cleaning liquids into the interior of the housings. Also, on the new design of the present invention, a moisture-tight, clear polymer hinged cover is made to shield the keypad and display from exposure to moisture when closed atop the housing.

Further modifications of the older sheet feeder of the '563 patent to render it useful in the food, pharmaceutical and medical products industries will be further explained below. To the best of applicant's belief, the present invention constitutes the first and only hygienic sheet feeder currently commercially available for use in the food processing and packaging industry.

SUMMARY OF THE INVENTION

It is believed that the sheet feeder described in the following specification and illustrated in the drawings is the first friction feeder especially designed for use in the food industry. As an example, it can be made to deliver cardboard disks onto a conveyor, later topped with a frozen pizza and printed advertising material before entering a film wrapping machine. The new friction feeder can be cleaned in place on a factory floor and need not be removed from its normal work station in order to effect cleaning. Further, the electronic components for the sheet feeder are self-contained rather than stored separately in a cable connected module. The use of bellows-style seals at entry points where shafts enter the mechanical and electrical housings permits adjustment of the shaft's height and belt tensions to accommodate sheets of differing thicknesses while precluding entry of cleaning fluids into the housings.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
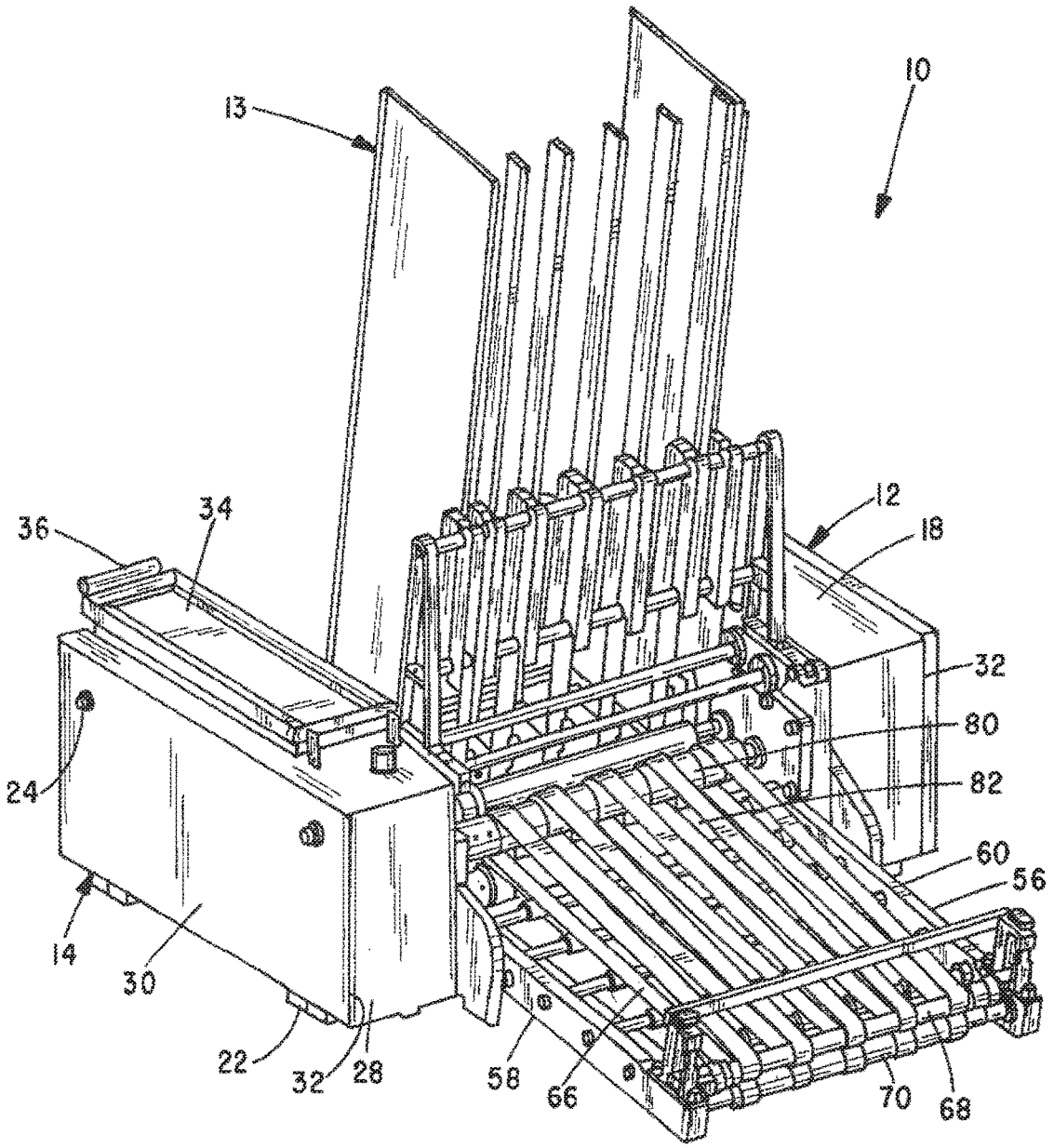
FIG. 1 is a perspective view of the sheet feeder of the present invention when viewed from one side of the product discharge end.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

In many respects, the sheet feeder of the present invention constitutes a modification of the sheet feeders described in the Vedoy et al Patents referenced above. It has been modified so as to comply with existing regulations for equipment that is intended to be exposed to food for humans and other animals. For example, under the provisions of 21 CFR 117.40, all plant equipment and utensils used in manufacturing, processing, packing or holding food must:

(1) Be designed and of such material and workmanship that they are adequately cleanable, and must be adequately maintained to protect against allergen cross-contact and contamination;

(2) Be designed, constructed and used appropriately to avoid the adulteration of food with lubricants, fuel, metal fragments, contaminated water or other contaminants;

(3) Be installed so as to facilitate cleaning and maintenance of the equipment and of adjacent spaces;

(4) Have food-contact surfaces that are corrosion-resistant when in contact with food;

(5) have food-contact surfaces made of non-toxic materials and designed to withstand the environment of their intended use and the action of food, and, if applicable, cleaning compounds, sterilizing agents, and cleaning procedures; and (6) Be maintained so that food-contact surfaces are protected from allergen cross-contact and from being contaminated by any source, including unlawful indirect food additives.

Applicable regulations further include the requirement that any equipment in areas where food is manufactured, processed, packed or held that does not come into contact with the food must be so constructed that it can be kept in a clean and sanitary condition. Good manufacturing practices further require that the performance of filling, assembling, packaging and other operations be carried out so that food is protected against allergen cross-contact, contamination and growth of undesirable microorganisms.

In redesigning its sheet feeder for use in the food processing and related industries, the named inventor at Multifeeder Technology, Inc., has redesigned its sheet feeding equipment to comply with these applicable standards. The following specification describes certain of the measures taken to achieve the desired results that are not readily obvious from the applicable industry standards.

Figure 2:
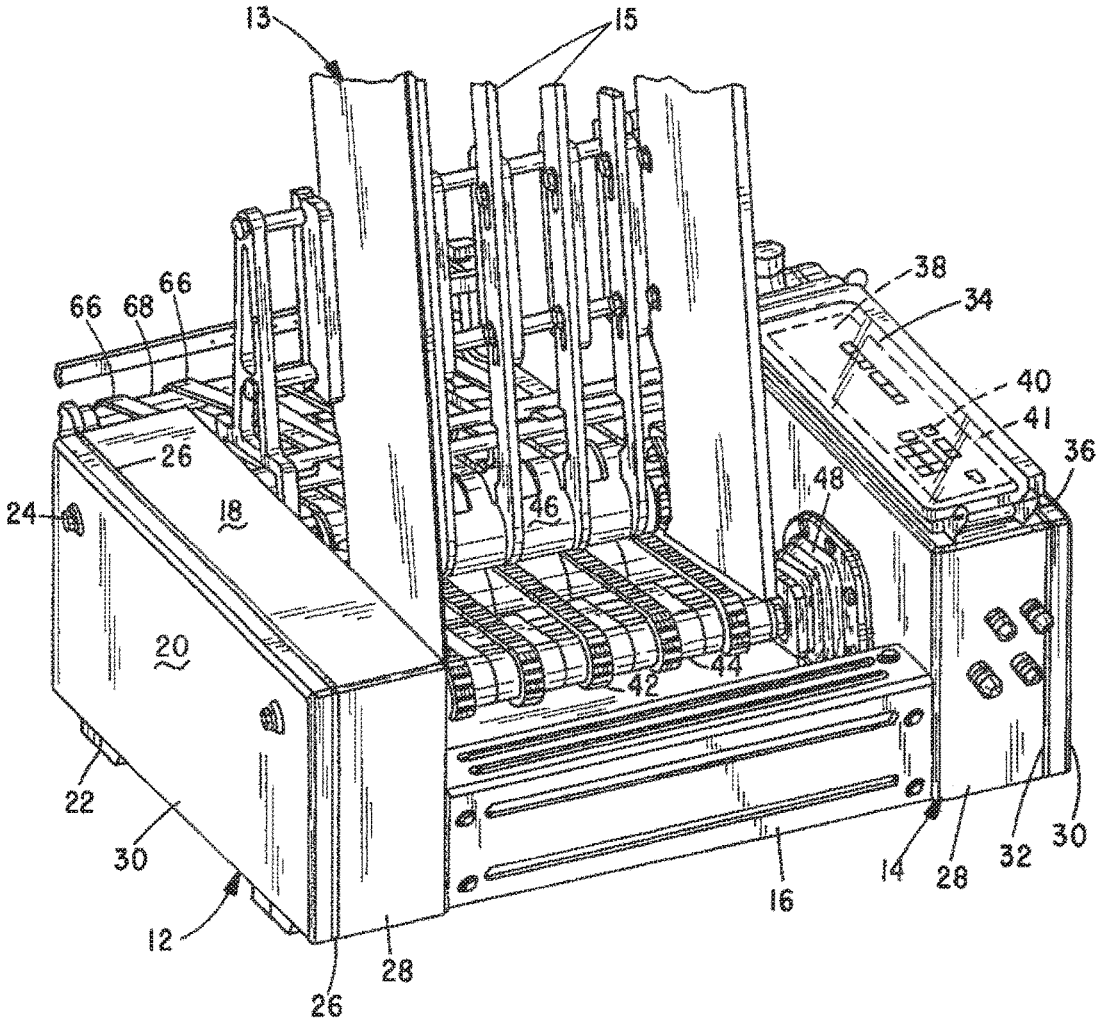
FIG. 2 is a close-up of the machine of FIG. 1 when viewed from one side of the product infeed end.
Figure 7:
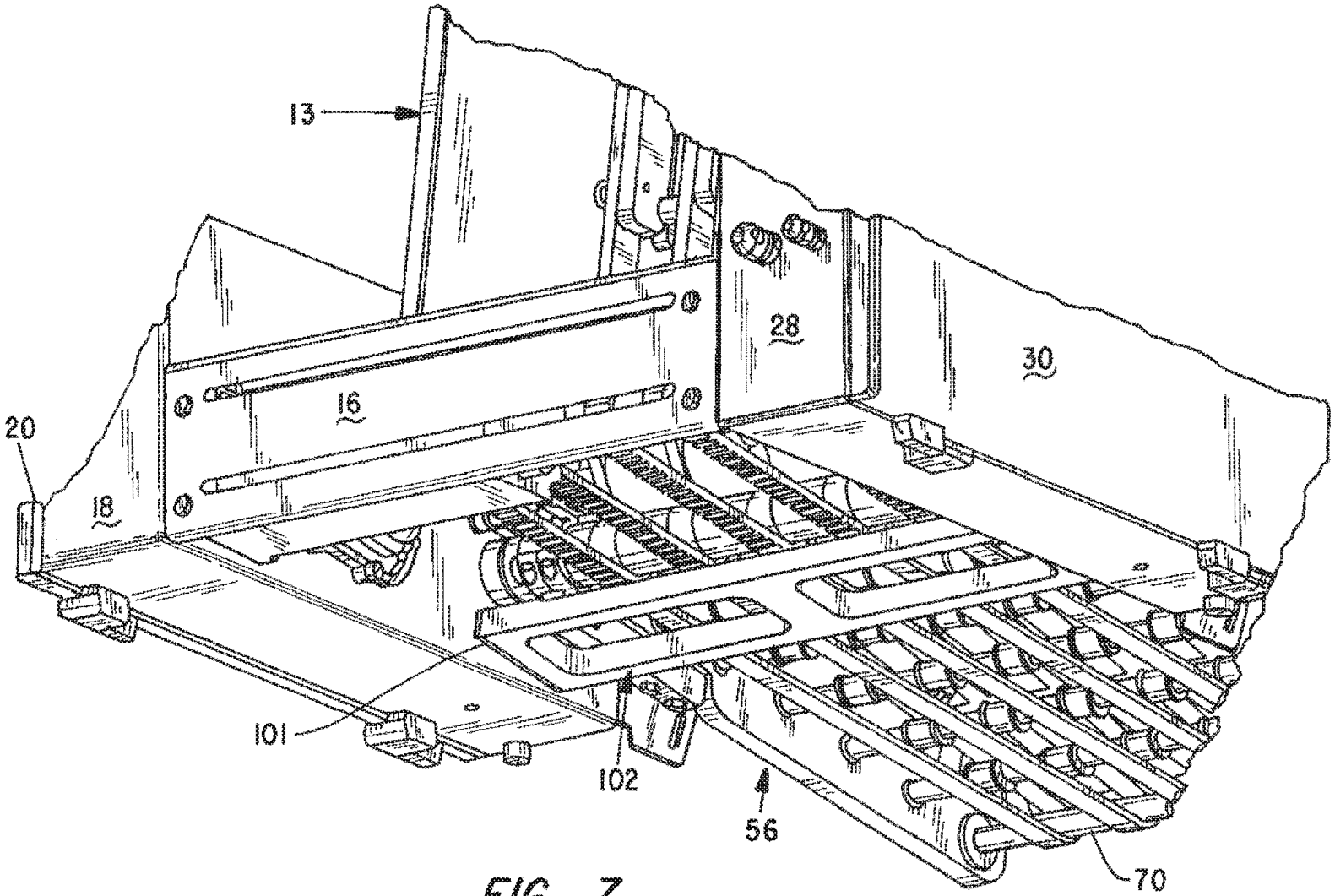
FIG. 7 is a partial bottom view of the preferred embodiment.

Referring to FIGS. 1 and 2, a preferred embodiment of a sheet feeder designed for use in the food industry is indicated generally by numeral 10. It includes a base comprising a pair of box-like housings 12 and 14 held in parallel, spaced-apart relation by a three cross members, including item 16 shown in FIG. 2 and item 102 shown in FIGS. 7, 8 and 12. The housing 12 contains the mechanical gearing and drive belts functionally similar to that shown in FIG. 4 of the '563 patent referenced above, but here the housing 12 is fabricated from stainless steel rather than ordinary cold rolled steel, aluminum, or molded polymer. It has an open-top box portion 18 with a removable cover 20 held by separable hinges, as at 22, and by hygienic cam locks as at 24, purposely selected to avoid Allen wrench sockets in their heads which might otherwise be difficult to clean. A liquid impervious gasket 26 formed in place in the removable cover 20 serves to prevent ingress of moisture between the cover and a box portion during cleaning operations.

Figure 5:
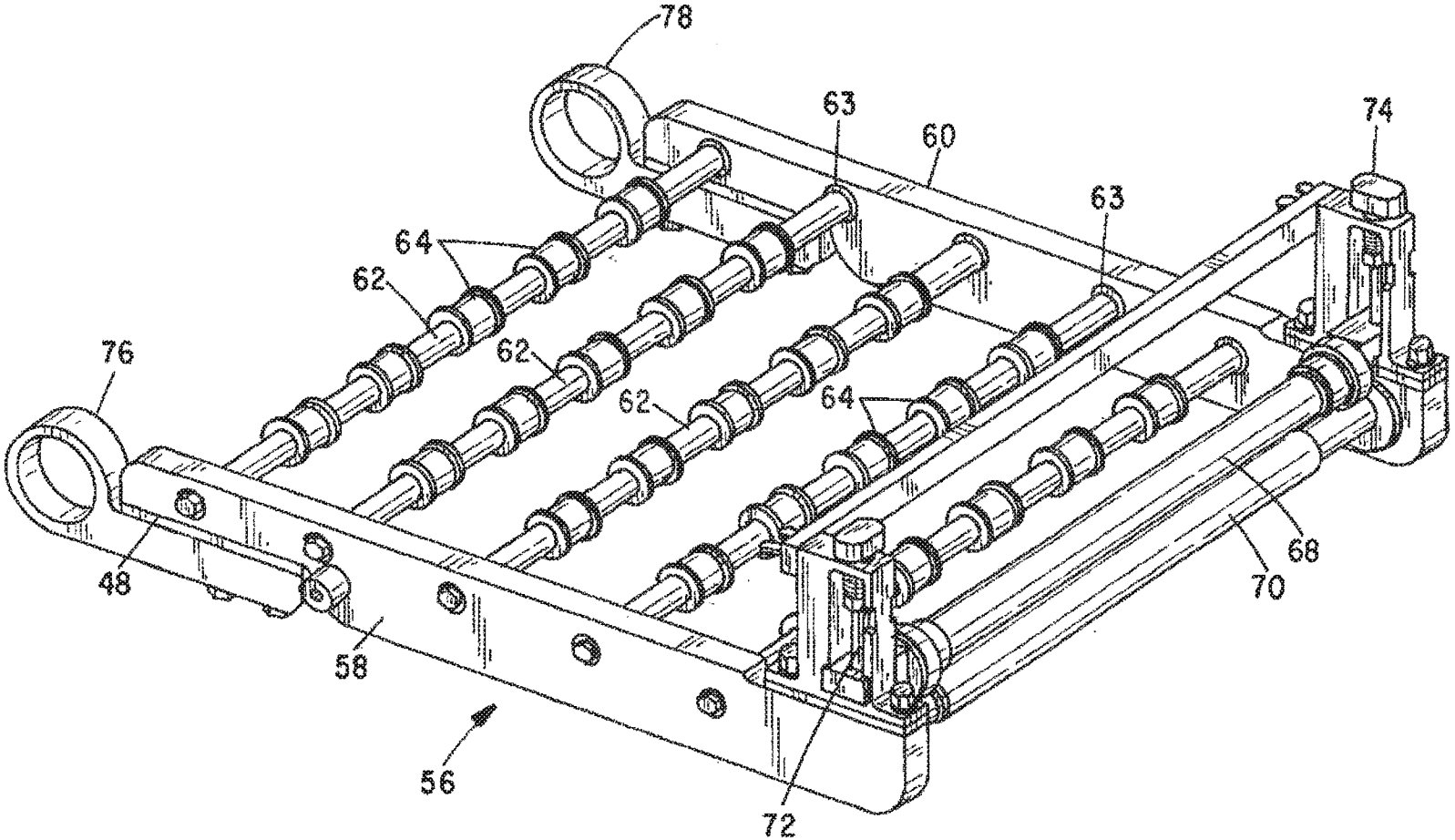
FIG. 5 is a detailed perspective view of the sheet feeder's discharge assembly removed from the rest of the sheet feeder and with the discharge belts removed.

The housing member 14, also of stainless steel, contains both mechanical gearing and drive belts, like that shown in FIG. 5 of the '563 patent, as well as the electronic circuitry for controlling operation of the sheet feeder. The housing 14 meets NEMA and IP66 standards and includes a box-like receptacle 28 having a removable cover 30 similar in construction to the housing 12 and also includes a gasket seal 32 formed in place in the removable cover 30 Attached to the top of the receptacle 28 is a clear polymer cover 34 that is hinged at 36 allowing it to be lifted from its covering relation with respect to an underlying display panel 38 and a key pad 40, like the display panel and key pad 94 of the Vedoy '563 patent. The clear polymer cover 34 also has a peripherally located gasket 41 that seals to the box-like receptacle 28 when the cover is closed.

Figure 10:
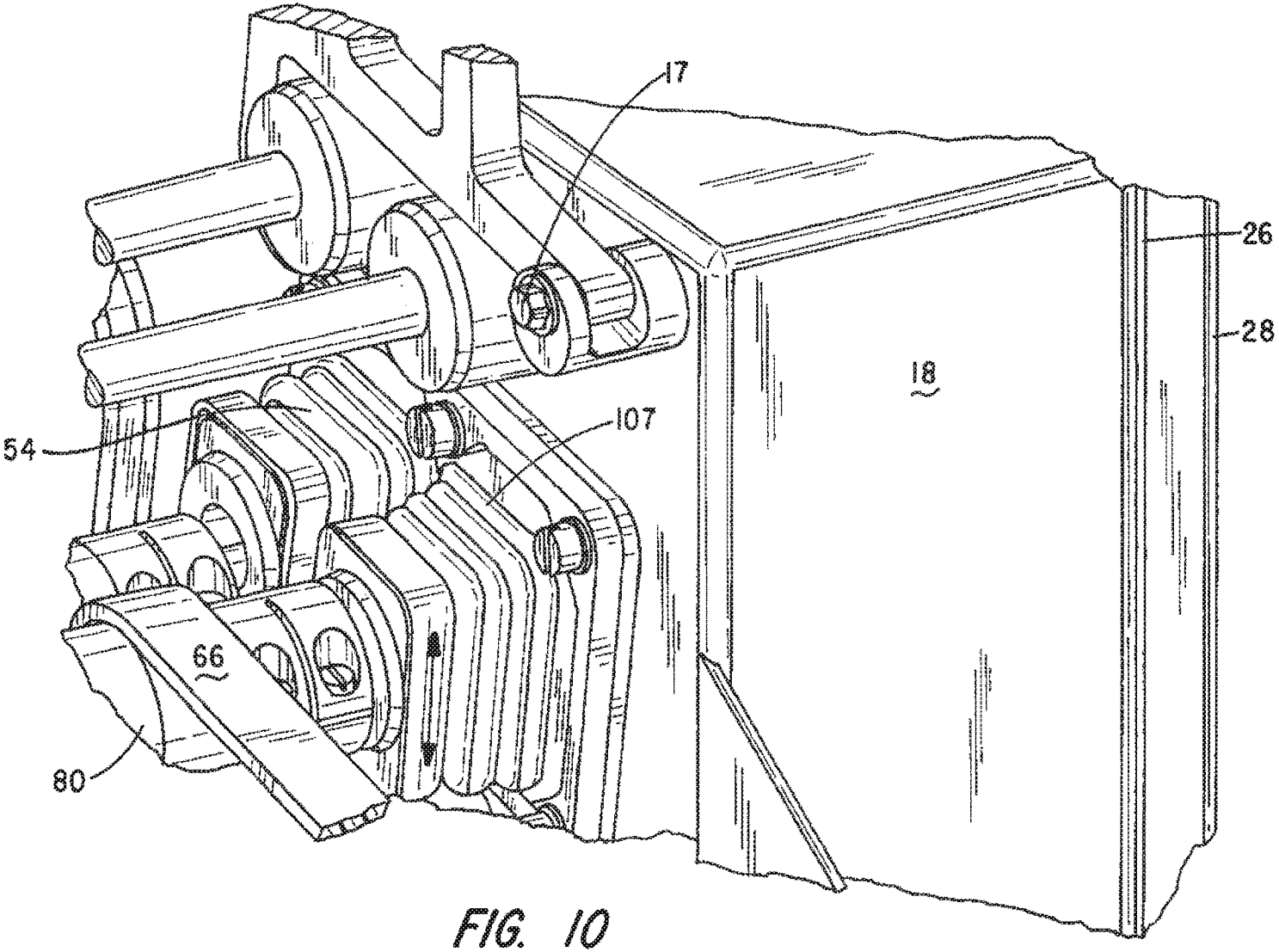
FIG. 10 is a close-up partial view of the junction between the mechanical housing and the upper discharge shaft and the on stripper shaft.

The upper and lower discharge belts 66 (see also FIG. 10) are deployed about motor driven upper and lower discharge drive shafts 80 and 82 respectively (see also FIG. 10). These shafts are each of a one-piece, multi-crown, undulating construction which avoids the use of multiple pulleys on shafts that were used in the earlier Vedoy '563 patent. In this way, there are no joints and crevices along the shafts that would otherwise make it more difficult and time consuming to sanitize.

Figure 3:
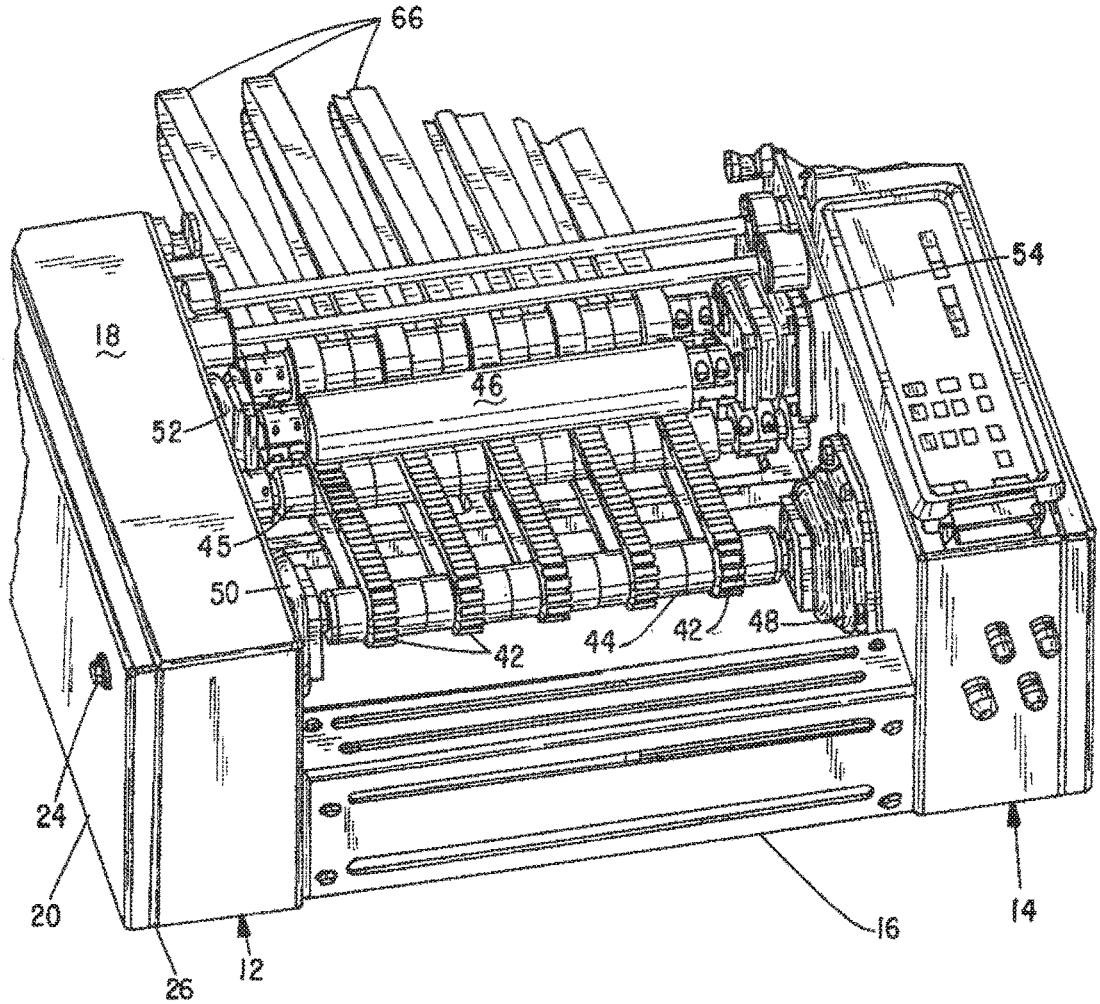
FIG. 3 is a close-up of the machine viewed from the product infeed end with the infeed hopper removed to better illustrate the infeed belts and stripper shafts.

Referring to FIG. 3, which shows a partial view of the sheet feeder 10 with its infeed hopper removed, the infeed belts 42 are deployed about a motor driven drive shaft 45 and an infeed idler shaft 44, each of a one-piece, multi-crown, undulating construction which avoids the use of multiple pulleys on shafts like 40 and 42 of the Vedoy '563 machine. In this way, there are no joints and crevices along the that would otherwise make it more difficult and time consuming to sanitize. Likewise, in the machine of the present invention, the stripper roller 46 is of a similar one-piece construction, thereby again eliminating the multiple pulleys on shafts, like 52 used in the Vedoy '563 patent.

Figure 3A:
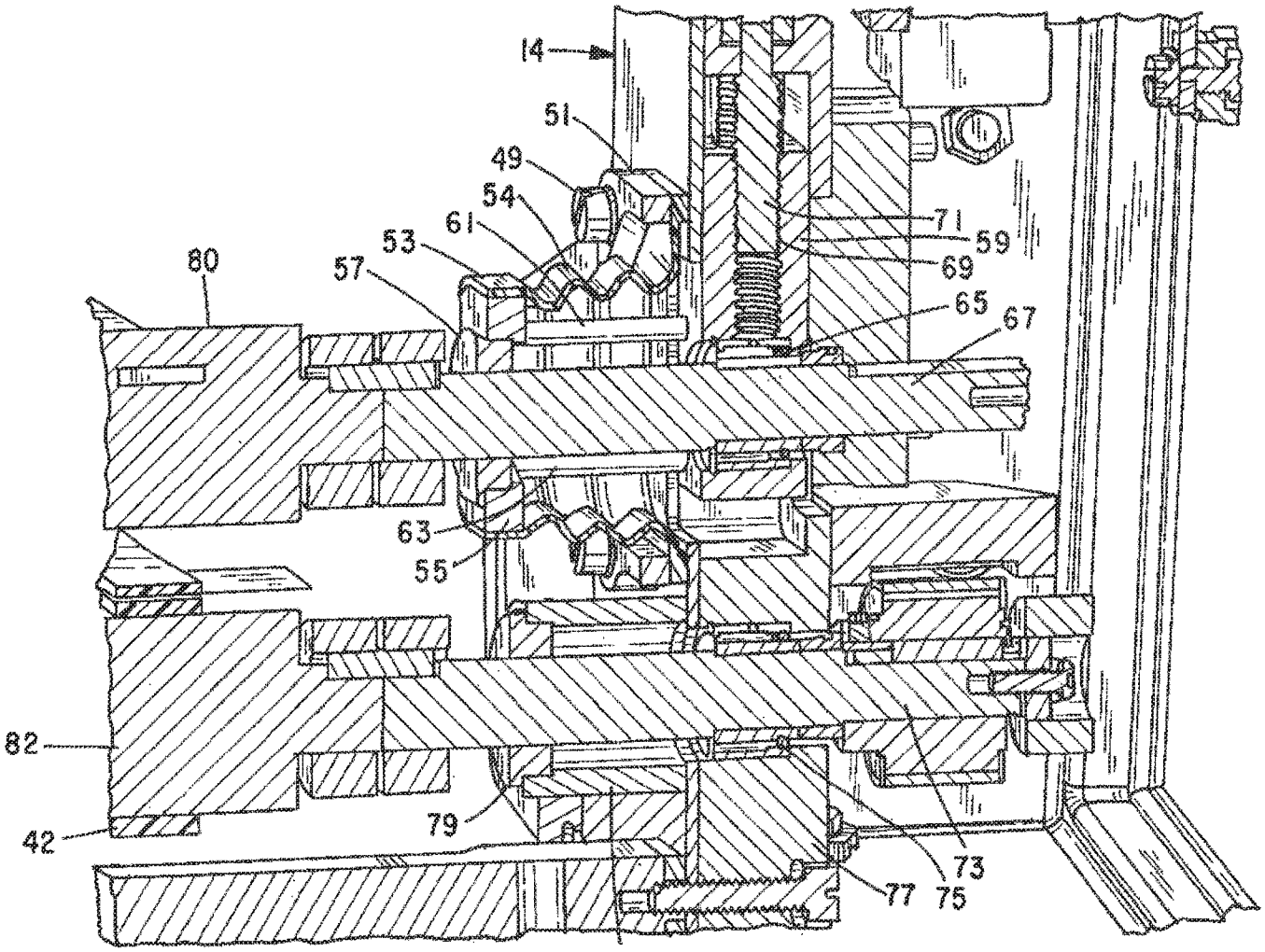
FIG. 3A is a partial cross-section view taken through the bearings and gap height adjustment mechanism in the area of item 54 in FIG. 3.
Figure 3B:
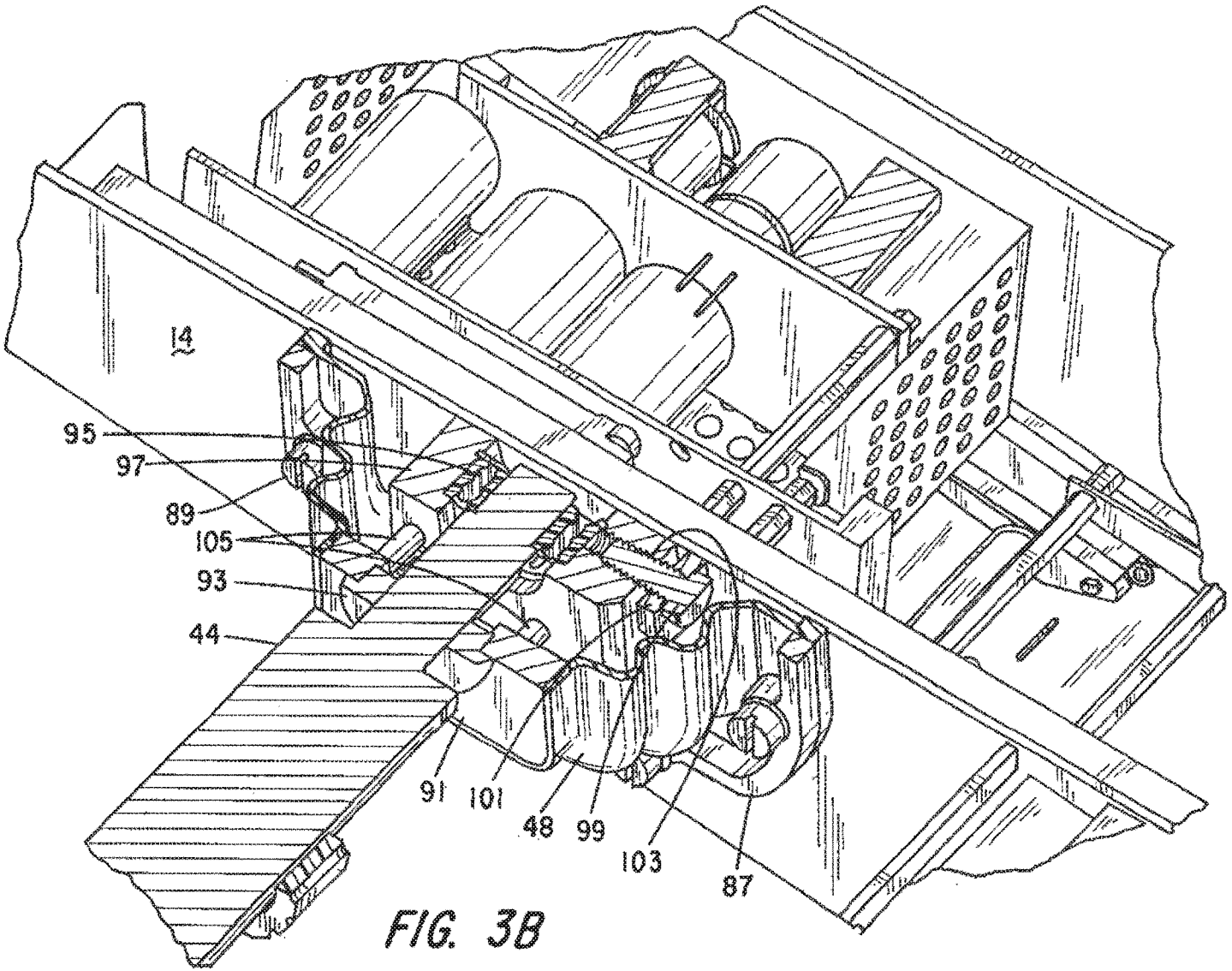
FIG. 3B is a partial cross-section view showing the mechanism for adjustment of the belt tension of the infeed belts in the area of item 48 in FIG. 3.
Figure 3C:
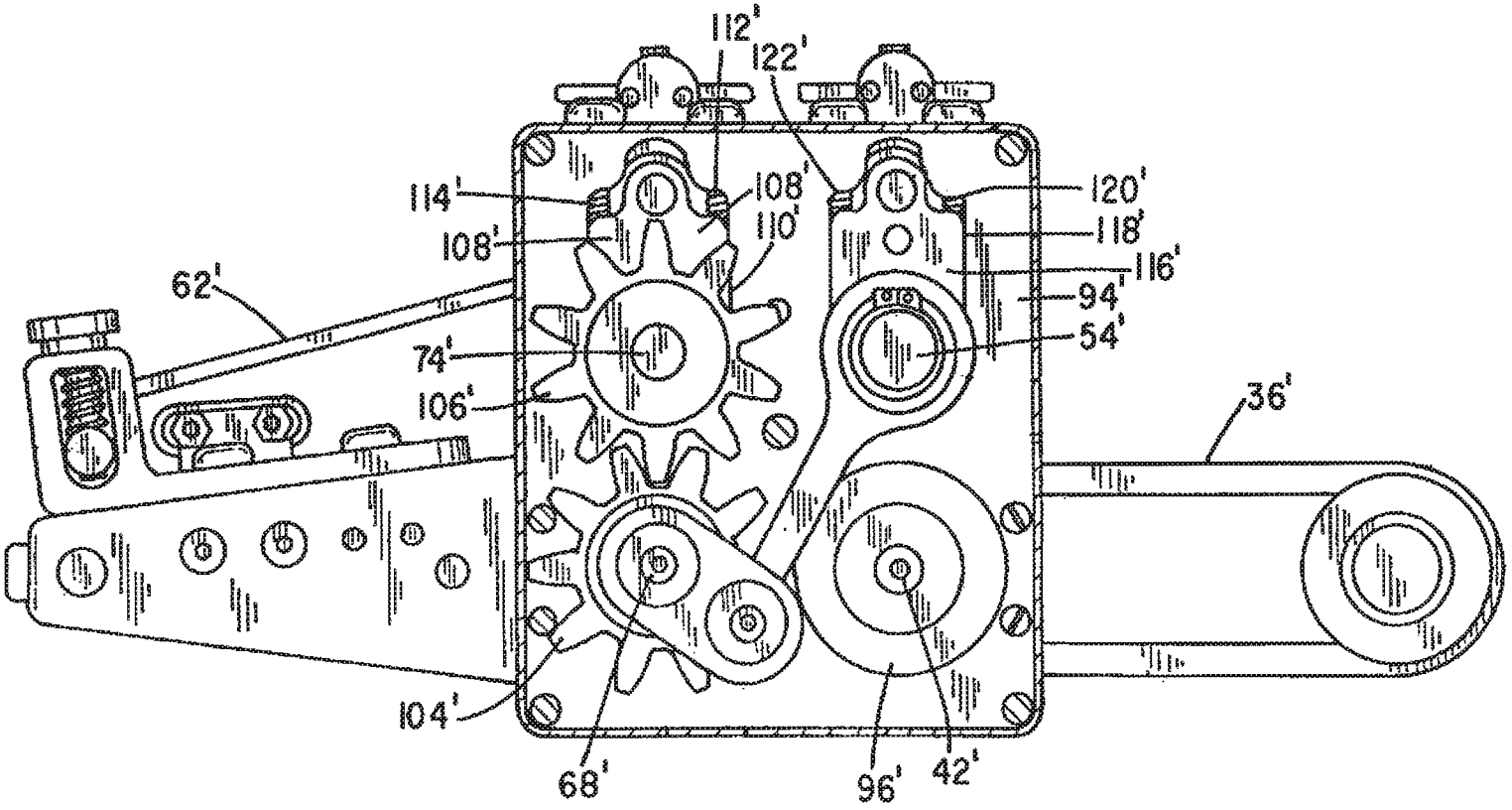
FIG. 3C is a partial left side elevation view of the preferred embodiment with the left side housing removed.
Figure 3D:
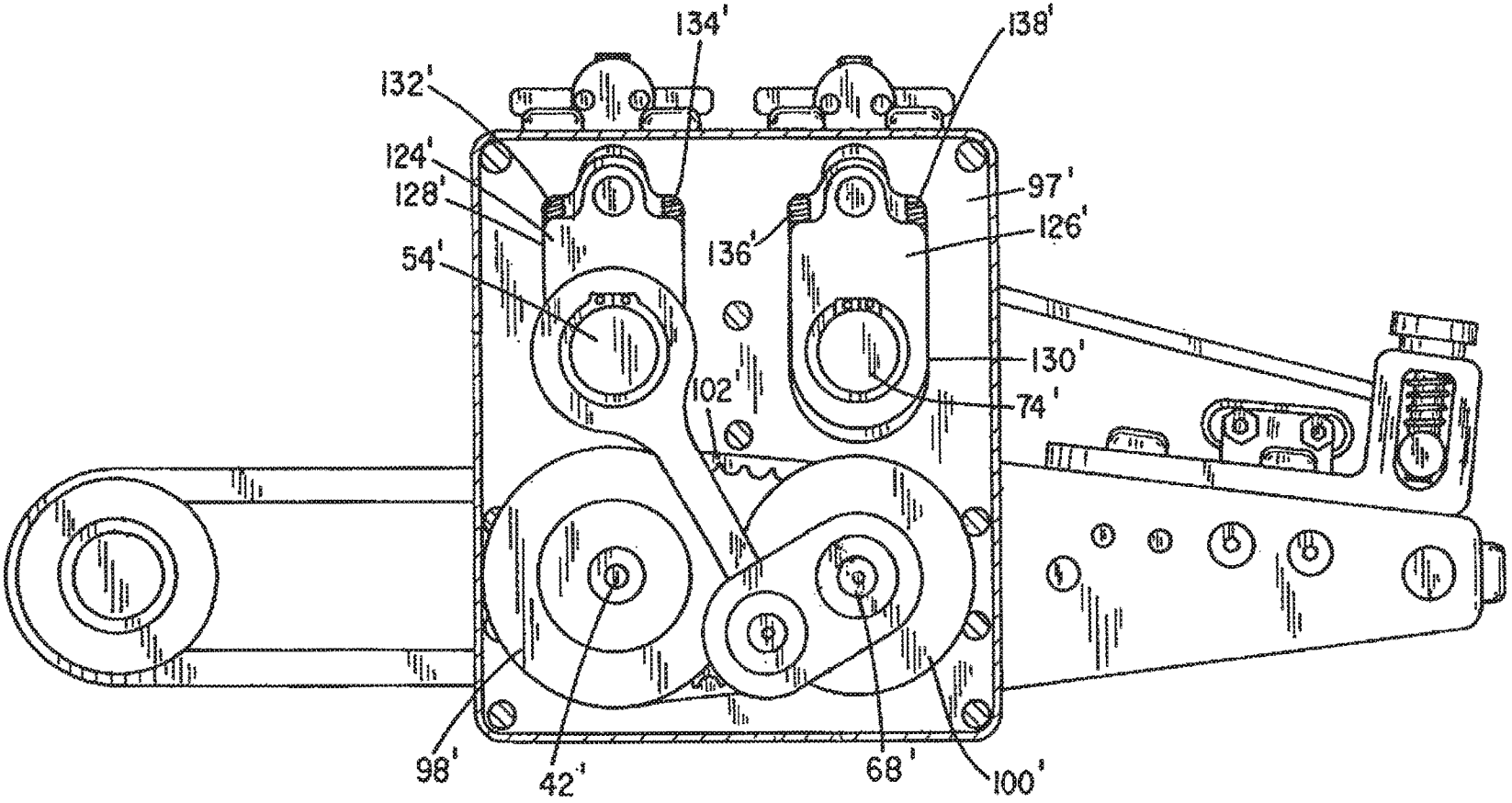
FIG. 3D is a partial right side elevation view of the preferred embodiment with the right side housing removed.

To better understand the drive mechanism for the endless feeder belts 36', the upper and lower endless discharge belts 62', FIGS. 3C and 3D respectively show a left side view and a right side view with the housings removed to reveal the working parts. As can be seen, the feed belt drive shaft 42' passes through a circular opening in the housing wall and then through a similar hole in a bearing support plate 94' that is affixed to the inside of the wall of the housing 14. Secured to the free end of the feed belt drive shaft 42' is a pulley 96' that is adapted to be driven by a motor by way of a timing belt.

Referring next to FIG. 3D, it can be seen that the shaft 42' passes through a circular opening formed in the back wall of the housing 12 and through a hole formed in a right bearing support plate 97' and that a timing belt pulley 98' is affixed to the right end of the shaft 42'. The lower discharge belt shaft 68' is journaled for rotation in bearings disposed in the right bearing support plate 97' and a further timing belt pulley 100' is affixed to the protruding end of the shaft 68'. A notched timing belt 102' is deployed about the pulleys 98' and 100' so that rotation of the feed belt drive shaft 42' by the motor also rotates the lower discharge output shaft 68'. The pulley 100' is of a slightly smaller diameter than the pulley 98' so that the discharge belt pulley 100' moves about 12 percent faster than the infeed belt 36'.

Referring again to FIG. 3C, the left end of the lower discharge belt shaft 68' is journaled for rotation in the bearing support plate 94' and has a spur gear 104' keyed to it. The spur gear 104' is arranged to mesh with a similar spur gear 106' that is affixed to the left end of the upper discharge belt shaft 74'. Hence, the upper discharge shaft 74' is made to turn at the same rotational speed as the lower discharge belt shaft 68', causing the adjacent flights of the discharge belts 62' and 60' to move in the forward direction at the same linear speed.

The upper discharge shaft 74' is journaled for rotation in a sliding bearing block 108' that is fitted into a vertically oriented slot 110' formed in the bearing support plate 94'. The sliding bearing block 108' preferably has its side edges treated with Teflon® or other lubricious material so to be free to move up and down vertically within the slot 110'. It is normally urged in a downward direction by compression springs 112' and 114' operatively disposed between shoulders formed on the sliding bearing block 108' and the upper edge of the slot 110' in the bearing mounting plate 94'.

By providing elongated teeth on the spur gears 104' and 106', they continue to remain meshed even with upward displacement of the shaft 74' against the force of the compression springs 112' and 114'.

The stripper wheel shaft 54' is also journaled for rotation in a sliding bearing block 116' fitted into a vertically oriented slot 118' in the bearing support plate 94'. Again, compression springs 120' and 122' normally urge the sliding bearing block 1116' and the shaft 54' downward toward the feed belt drive shaft 42'.

Returning again to FIG. 3D, it shows the right ends of the stripper wheel shaft 54' and the upper discharge shaft 74', each being journaled for rotation in separate sliding bearing blocks 124' and 126', respectively. These sliding bearing blocks are again fitted into vertically oriented slots 128' and 130' in the bearing support plate and are preferably coated along their side edges with a lubricious material for facilitating low friction sliding contact between the bearing blocks and their associated slots. Compression springs, as at 132', 134' 136' and 138', normally urge the sliding bearing blocks 124' and 126' toward the underlying shafts 42' and 68'.

In order to be able to adjust the tension of the infeed belts 42 and the spacing (height) of the gap between the infeed belts 42 and the stripper roller 46 to accommodate sheet items of differing thicknesses in the manner described in column 7, line 9 through column 8, line 15, of the Vedoy '563 patent and as also described in greater detail in the Vedoy '613 patent, while still blocking entry of water or cleaning chemicals into the interior of the housings 12 and 14, bellows gaskets 48, 50 (FIGS. 3 and 3B) incorporating bearing isolators, fit over apertures in the housings leading to the slidable bearing assemblies for the infeed idler shaft 44.

Similar "double" bellows gaskets 52, 54 (FIGS. 3 and 3A) fit about housing apertures leading to the slidable bearings used to journal the stripper roller 46 and upper discharge drive shaft 80 (FIGS. 1 and 3A).

FIG. 3A is a partial cross-section view taken through the bearings and gap height adjustment mechanism (in the area of item 54 in FIG. 3) for setting the spacing between the infeed belts 42 on infeed shaft 45 and the stripper rollers 46, and between the upper and lower discharge drive shafts 80 and 82 respectively. Seen clamped to a the back wall of the housing 14 by a clamping ring 51 and precision length shoulder screws 49 is the accordion-pleated, flexible, elastomeric double bellows member 54. Vulcanized to its proximal end 53 are two stainless steel plates 55 in which are fitted bearing isolators 57 of a multi piece labyrinth design allowing the shaft to rotate while precluding entry of water or other cleaning fluid and also preventing the loss of bearing lubricants.

The plates 55 are joined to each of two slide blocks 59 by screws within precision length spacers 61 and 63, respectively, four screws and spacers per plate. The screws within spacers extend through a slot formed through the housing wall 14. The slide blocks 59 have combination radial-axial locating bearings 65 for journaling extensions 67 of the upper discharge drive shaft 80 and stripper shaft 46. The slide blocks 59 have a vertically extending threaded bore 69 into which is inserted a lead screw 71 which, when turned, raises or lowers the stripper roller 46 and upper discharge drive shaft 80 relative to the infeed roller 45 for adjusting the height of the gaps there between.

The above adjusting mechanism is isolated from the (food or pharmaceutical) product area of the sheet feeder in a hygienic design by the first and second pairs of flexible elastomeric bellows incorporating molded in plate and bearing isolator. The bellows, plate and isolator are precisely aligned and connected to and move with the above first and second movable bearing blocks. All the items above referring to FIG. 3A together comprise a hygienic height adjustment mechanism.

Figure 8:
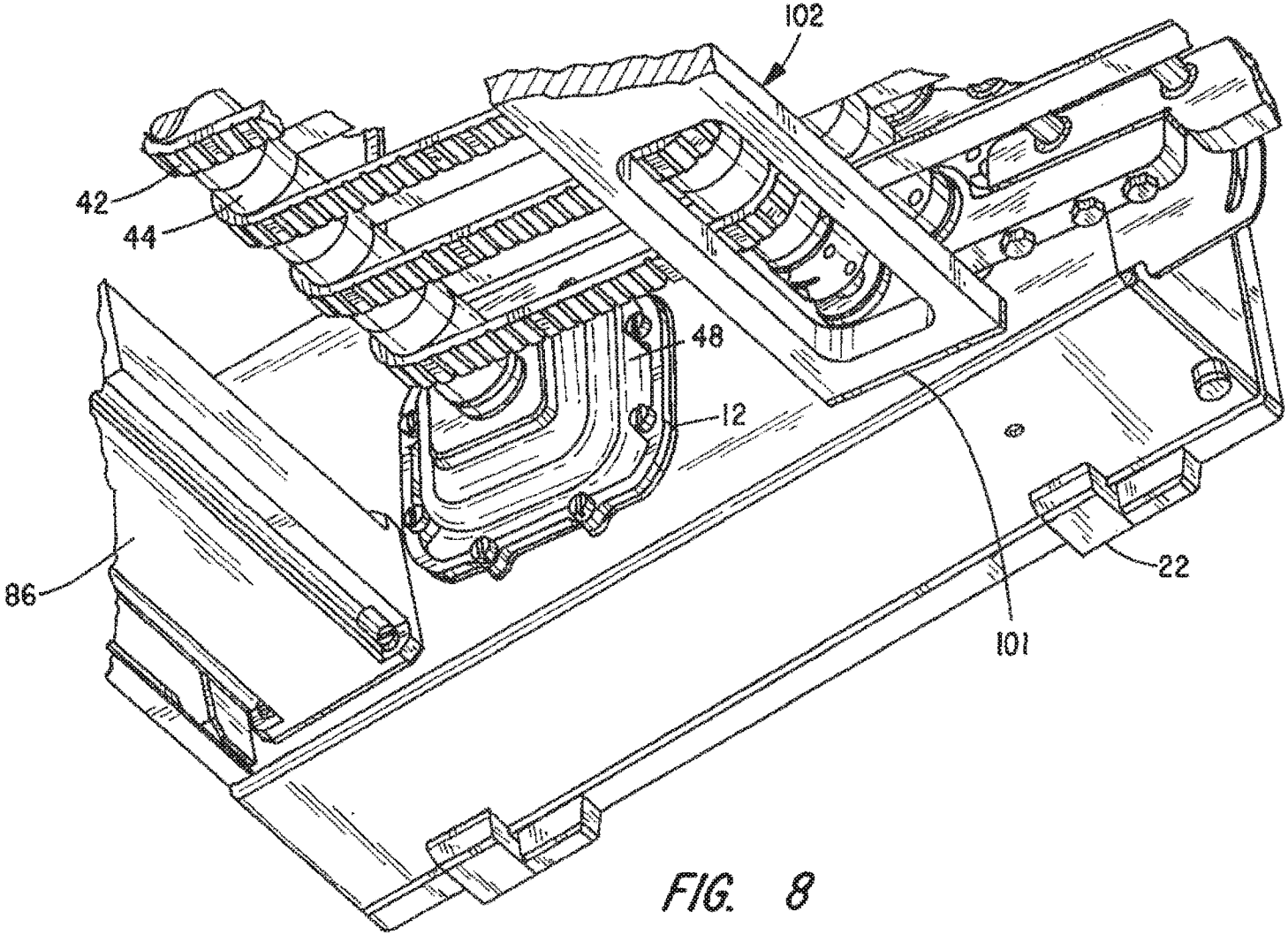
FIG. 8 is a further partial bottom view showing the infeed shaft and bellows style gasket employed with it. Also shown is one of the cross members and it's gasket seal.
Figure 9:
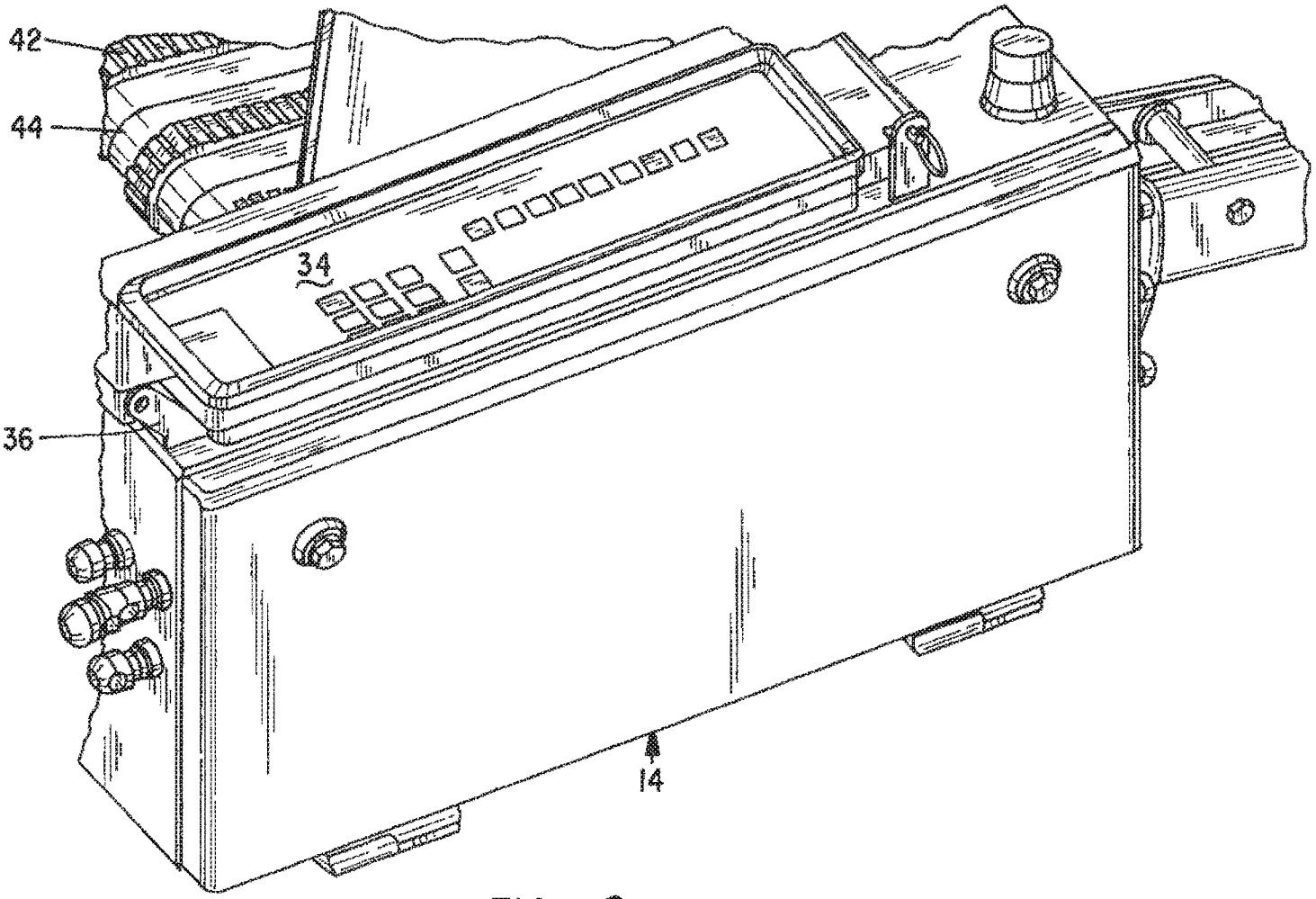
FIG. 9 shows the electronics housing with a keypad and display viewable beneath a water-tight clear polymer hinged cover.
Figure 11:
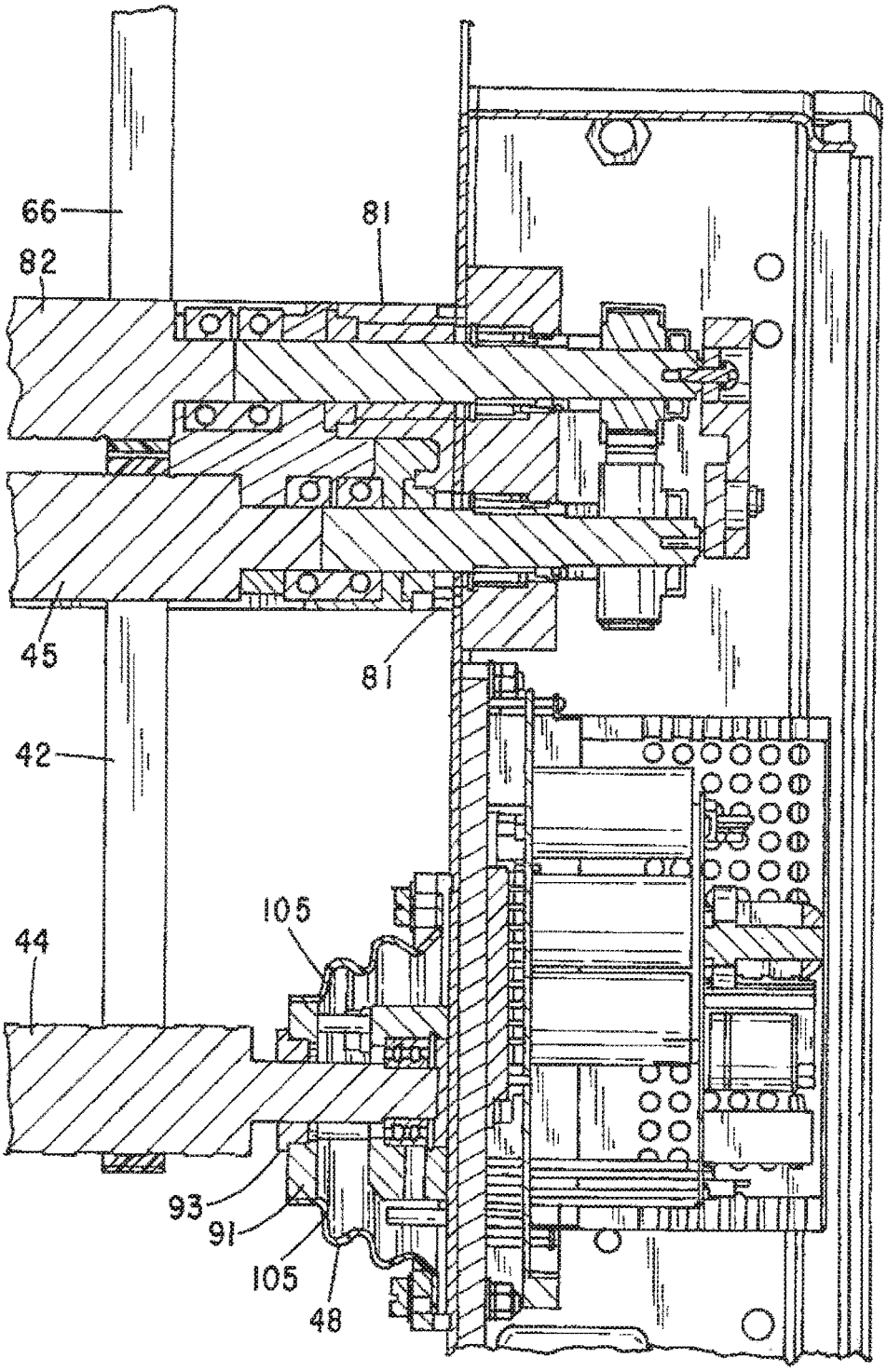
FIG. 11 is a sectioned view taken through the infeed drive shaft, the infeed idler shaft and the lower discharge shaft.

The precision turned lower discharge shaft extension 73 is journaled for rotation in a combination radial-axial locating bearing 75 fitted into a stationary block 77 bolted to the inner wall of the housing 14 after passing through a further bearing isolator 79 and a tubular steel spacer 81 that is immovably affixed (welded) to the outer wall surface of the housing 14. The infeed drive shaft 45 is driven from a toothed sprocket from the motor 86 seen in the bottom view of FIG. 8 via a toothed belt (not shown) contained within the housing 12. As seen in FIGS. 3, 8 and 11, the same type of shaft to housing sealing arrangement immovably affixed (welded) is employed on the opposed ends of the lower discharge drive shaft 82.

Referring next to FIG. 3B, shown is a cross-section through the infeed idler shaft 44 of FIG. 2. Again, to seal the assembly against entry of cleaning solutions which may be delivered via a pressure-washer source or other means, a flexible, elastomer bellow 48 is clamped to the outer surface of the back walls of housings 12 and 14 using clamp rings as at 87 and slot head precision length shoulder screws 89, as illustrated. Again, the bellows 48 are vulcanized to a stainless steel plate 91 having a center bore 93 in which is fitted a commercially available bearing isolator of known construction having a labyrinth seal that functions to prevent entry of fluids into the cavity containing components including roller bearing 95 that journals the ends of the infeed shaft 44. The roller bearings 95 are disposed within a slide block 97. An adjustment lead screw 99 passes through a plate 101 fastened to the outer side of the back wall of the housing 14 and into a threaded bore 103 in the slide block 97 so that rotation of the lead screw 99 laterally displaces the slide block as well as the plate 91 and shaft 44 horizontally due to the screws within precision length spacers 105 connecting the two together to thereby loosen or tighten the belt tension of the infeed belts 42 (FIG. 2).

The above adjusting mechanism is isolated from the (food or pharmaceutical) product area of the sheet feeder in a hygienic design by the third pair of flexible elastomeric bellows incorporating molded in plate and bearing isolator. The bellows, plate, and isolator are precisely aligned and connected to and move with the above third movable bearing blocks. All the items above referring to FIG. 3B together comprise a hygienic belt adjustment mechanism.

Figure 4:
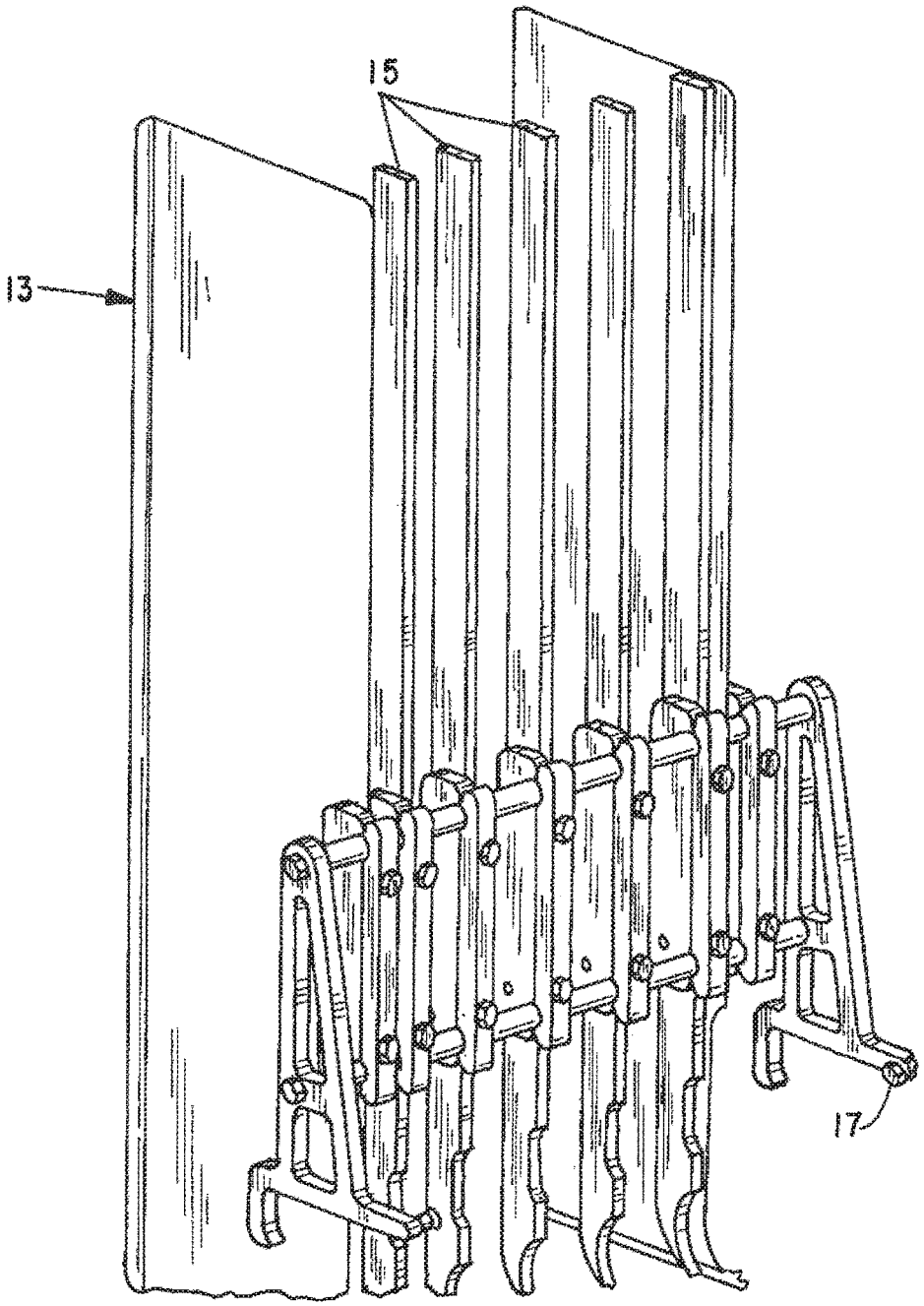
FIG. 4 is a perspective view of the infeed hopper removed from the sheet feeder.

Referring next to FIG. 4, it shows the sheet infeed hopper 13 of FIGS. 1 and 2 removed from the sheet feeder's base. It is designed to allow it to be readily removed from the base to be cleaned in a dipping or emersion-type cleaning operation. It optionally can be cleaned in place with minimal disassembly of removing guide rods 15. The vertical sheet guide rods 15 have an arcuate contour at their lower ends to closely conform to and straddle the stripper roller 46, as shown in FIG. 2, when the hopper assembly is bolted to the rear surface of the housings 12 and 14 by two bolts 17, one per side, as seen in FIG. 10. Removal of just two bolts 17 allows quick release of the hopper assembly as a unit from the sheet feeder base.

Figure 6:
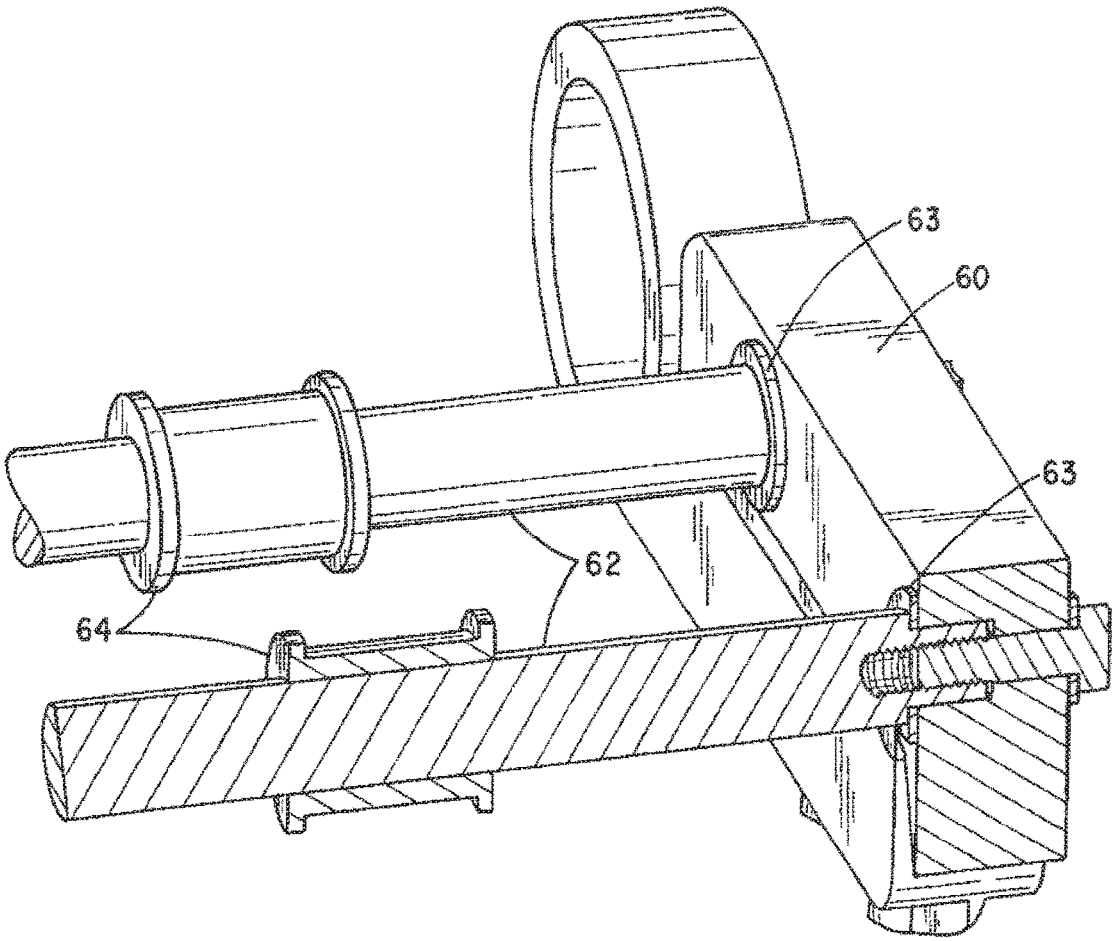
FIG. 6 is a partial view of the discharge assembly showing the shaft attachment in cross-section.

FIG. 5 is a detailed, perspective view of the sheet feeder's discharge assembly with the discharge belts absent to better show the constructional details. It is indicated generally by numeral 56 and seen to comprise a pair of parallel stainless steel side plates 58 and 60 with a plurality of stationary cylindrical rods 62 held in parallel alignment with one another along the length dimension of the discharge assembly 56. Flat, toroidal seals 63 surround the stationary rods 62 at their points of entry of the plates 58, 60, as best seen in FIG. 6. The fasteners used to retain the rods 62 are also sealed with toroidal seals of the same type as 63. Mounted for rotation on the plurality of rods 62 are belt spools 64 over which a set of endless belts 66 (FIG. 3) are strung leading to nose rollers 68 and 70. Again, the spacing between these two nose rollers is adjustable by means of the Vernier adjustment screws 72 and 74 fitted into threaded retainers on the ends of the upper nose roller 68. Mounting rings 76 and 78 are bolted to the side rails 58, 60 and are designed to surround the tubular steel spacer 81 (FIGS. 3A and 11). In this way, the discharge assembly can also be readily removed from the remainder of the sheet feeder as a unit, allowing it to be cleaned separately from the rest of the sheet feeder it optionally can be cleaned in place with minimal disassembly of removing the upper discharge sub-assembly for separate cleaning. The discharge belts 66 ride over the spools 64 and a sufficient clearance is provided between the shafts and the ID of the spools to permit effective entry of cleaning fluid to flush out any microorganisms. The spools are also easily moved axially on the shafts to facilitate cleaning of the entire shaft surfaces.

Referring to FIG. 8, the motor for driving the infeed conveyor, the discharge conveyor and the stripper rollers is identified by numeral 86. Also shown is crossbar 102 and seal 101 used for precision alignment of mechanisms contained in housings 12 and 14 of FIGS. 1, 2, and 3. The gearing and drive belts involved are contained within the housings 12 and 14 and are more particularly described in the Vedoy '563 patent.

As seen in FIG. 10, the upper discharge shaft 80 has a bellows-type seal arrangement 107 clamped to the rear panels of housings 12 and 14 surrounding the entry points of the shaft 80 into the housings. The seal arrangement for the mechanism for adjusting the spacing between the upper and lower discharge shafts is quite similar to that used on the stripper shaft 46 and its description need not be repeated here.

Figure 12:
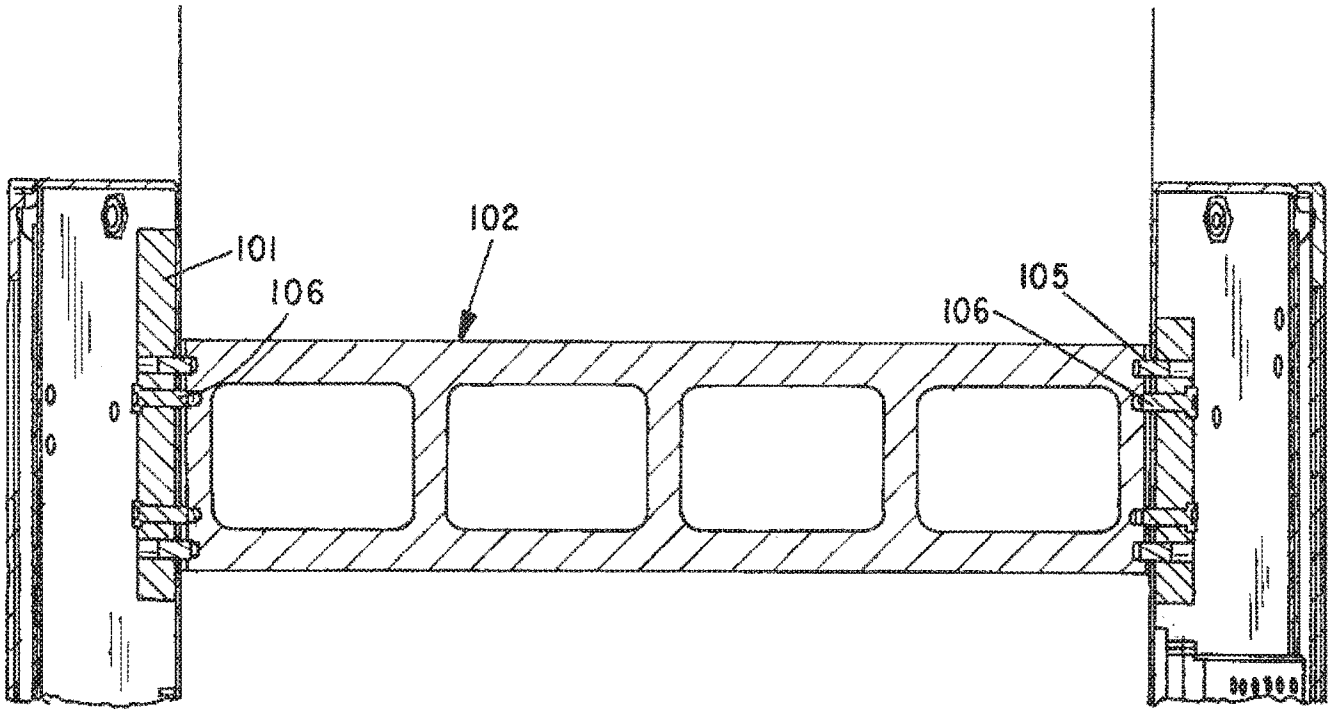
FIG. 12 is a cross-section view taken through a cross bar connecting the housings to one another.

FIG. 12 is a cross section cut through the cross bar 102 and seal gaskets 101. Crossbar 102 abuts housings 12 and 14. The joint is sealed in a hygienic design by seal gaskets 101. More importantly, it is used to precisely align and connect the first and second movable bearing blocks 59 and first stationary bearing block 77 in housing 12 with the same blocks in housing 14 with precision dowel pins 105 and fasteners 106. This precise alignment is independent of the particular location of the stationary bearing blocks in housings 12 and 14.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

The invention claimed is:

1. In a computer controlled sheet feeder having first and second housings held in parallel, spaced-apart relation by a cross member, each of said housings comprising a back wall with four integrally formed, mutually perpendicular side walls defining an open front with a removable cover for closing the open front, the first housing containing a computer-based motor control circuit and each of the first and second housings containing;

(i) a first movable bearing block for supporting an end of a motor driven upper discharge drive shaft penetrating through first apertures in each of the back walls of the first and second housings;

(ii) a second movable bearing block for supporting an end of a stripper roller shaft penetrating through second apertures in each of the back walls of the first and second housings;

(iii) at least one stationary bearing block enclosing the first and second movable bearing blocks and for respectively supporting an end of a lower discharge drive shaft and an end of an infeed drive roller shaft penetrating through third and fourth apertures in each of the back walls of the first and second housings;

(iv) a third movable bearing block for supporting an end of an infeed idler roller shaft penetrating through fifth apertures in the back walls of the first and second housings wherein the improvement comprises hygienic belt adjustment members including:

a) first, second and third pairs of flexible elastomeric bellows, each of the bellows with first and second ends, a first end of one of the first pair of bellows being sealed against: the back wall of the first housing and the other of the first pair of bellows being sealed against the back wall of the second housing, each in covering relation to the first apertures, a first end of one of the second pair of bellows sealed against the back wall of the first housing and the first end of the other of the second pair of bellows sealed against the back wall of the second housing, each in covering relation to the second apertures and where the second ends of each of the first, second and third pairs of bellows supports a bearing isolator surrounding a respective one of said infeed idler roller shaft, said stripper roller shaft, said lower discharge drive shaft and said upper discharge drive shaft;

(v) a plurality of endless belts surrounding the infeed drive roller shaft and the infeed idler roller shaft.

2. The sheet feeder of claim 1 wherein each of the third and fourth apertures is surrounded by a tubular spacer that has a first end immovably affixed to the back wall of a respective one of the first and second housings so as to project outwardly therefrom and support a bearing isolator in a second end of each of the tubular spacers.

3. The sheet feeder of claim 1 wherein the input feed shaft, input idler shaft, upper discharge drive shaft, and lower discharge drive shaft, includes a plurality of alternating crowns and valleys along length dimensions thereof.

4. The sheet feeder of claim 1 wherein the stripper roller shaft is of a uniform diameter over a predetermined center portion thereof.

5. The sheet feeder of claim 1 wherein the first housing includes a human interface control panel in one of the side walls and an overlaying, one-piece, transparent cover removably hinged to said one side wall, the cove including a peripheral gasket for inhibiting entry of liquids onto the control panel when the cover is in a closed position relative to the one side wall.

6. The sheet feeder of claim 1 and further including a product input hopper assembly attachable to and between the first and second housings, said hopper adapted to hold a quantity of flat sheet products in stacked relation and said hopper being removable from the first and second housings as a unit for cleaning.

7. The sheet feeder of claim 1 wherein first and second housings are formed from stainless steel.

8. The sheet feeder of claim 1 wherein the third movable bearing blocks each include a central bore containing and outer bearing race and whose inner bearing race journals the motor driven infeed idler shaft and a transversely extending threaded bore, the third movable bearing blocks being affixed individually to plates joined to the back walls of the first and second housing by shoulder bolts which, when rotated, displace the third movable bearing blocks horizontally relative to their associated plates.

9. The sheet feeder of claim 1 wherein the first and second movable bearing blocks include central bores containing bearings having an outer bearing race and an inner bearing race that journals the stripper roller shaft and the upper discharge shaft, the first and second moveable bearing blocks each with a vertically oriented threaded bore for receiving a lead screw therein where rotation of each lead screw displaces the first and second movable bearing blocks vertically relative to the back walls of the first and second housings.

10. The sheet feeder of claim 1 and further including a discharge conveyor assembly that is detachable as a unit from the remainder of the sheet feeder for cleaning.

11. The sheet feeder of claim 1 wherein the at least one stationary bearing block in the first housing is operatively aligned with the at least one stationary bearing block in the second housing independent of their particular, respective contacts with the wall surfaces of the first and second housings.

* * * * *